US008053696B1

(12) United States Patent
Lin

(10) Patent No.: US 8,053,696 B1
(45) Date of Patent: Nov. 8, 2011

(54) ELECTRIC CONNECTOR SWITCH

(76) Inventor: Shan Chaing Lin, Taoyuan Hsien (TW)

( * ) Notice: Subject to any disclaimer, the term of this patent is extended or adjusted under 35 U.S.C. 154(b) by 0 days.

(21) Appl. No.: 12/078,461

(22) Filed: Mar. 31, 2008

(51) Int. Cl.
*H01H 3/00* (2006.01)

(52) U.S. Cl. ..... 200/339

(58) Field of Classification Search ..... 200/339, 200/238, 19.18, 11 R, 11 TC, 200, 563, 6 A, 200/406; 439/188
See application file for complete search history.

(56) References Cited

U.S. PATENT DOCUMENTS 6,399,904 B1 * 6/2002 Mimata ..... 200/6 A
6,459,354 B2 * 10/2002 Konda et al. ..... 337/9
6,864,454 B2 * 3/2005 Shimizu et al. ..... 200/563
6,969,812 B2 * 11/2005 Shimizu et al. ..... 200/200
2005/0287856 A1 * 12/2005 Hu et al. ..... 439/188
2008/0087529 A1 * 4/2008 Asada ..... 200/19.18

* cited by examiner

*Primary Examiner* — Edwin A. Leon

(57) ABSTRACT

An electric connector switch for connecting lighting fixtures to a power cable is disclosed to include an electrically insulative housing, a connector body mounted inside the housing to hold a grounding unit and a conducting unit, and a switching member for controlling on/off status between the conducting unit and the power cable. The conducting unit has two fixed electrodes respectively connected to the positive and negative poles of the power cable, and a movable electrode, which has one end constantly kept in contact with one fixed electrode and the other end movable by the switching member between the on position to contact the other fixed electrode and the off position to be disconnected from the other fixed electrode.

3 Claims, 7 Drawing Sheets

6-6

ELECTRIC CONNECTOR SWITCH

BACKGROUND OF THE INVENTION

1. Field of the Invention

The present invention relates to electric connector switch and more particularly to an improved structure of electric connector switch, which allows the user to switch on/off the connected lighting fixtures, saving power consumption.

2. Description of the Related Art

FIG. 1 illustrates a conventional connector switch 10 for connection between lighting fixtures and a power cable. The connector switch 10 is controllable to switch on/off of all the connected lighting fixtures at a time, i.e., when the connector switch 10 is switched on, all the lighting fixtures are turned on to emit light. On the contrary, when the connector switch 10 is switched off, all the lighting fixtures are turned off. However, the connector switch 10 does not allow the user to switch on one or a number of the linked lighting fixtures while keeping the other linked light fixtures off.

Further, when multiple lighting fixtures are arranged at different exhibition spots in an exhibition hall and connected to one same power cable through the aforesaid conventional connector switch 10, the connector switch 10 does not allow the user to switch on one specific lighting fixture in lighting up one specific exhibition item while the other lighting fixtures are kept off.

SUMMARY OF THE INVENTION

The present invention has been accomplished under the circumstances in view. It is the main object of the present invention to provide an electric connector switch, which is practical for use to connect lighting fixtures to a power cable and to control on/off status of the lighting fixtures, saving power consumption.

To achieve this and other objects of the present invention, the electric connector switch comprises an electrically insulative housing that defines a switch hole, a connector body, which is mounted inside the housing and has an axle holder, a grounding unit, which is mounted in the connector body and comprises a metal grounding spring member and a fastening member fastened to the axle holder to affix the metal grounding spring member to the connector body, a conducting unit mounted in the connector body for connection to a power cable, and a switching member adapted for switching on/off the connection between the conducting unit and the power cable. The grounding unit comprises a first fixed electrode and a second fixed electrode respectively connected to the power cable, and a movable electrode. The movable electrode has a first contact end and a second contact end. The second contact end is constantly kept in positive contact with the second fixed electrode. The first contact end is movable between a first position where the first contact end is kept in positive contact with the first fixed electrode, and a second position where the first contact end is moved away from the first fixed electrode. The switching member is pivotally coupled to a pivot hole on the connector body, having a handle extending out of the electrically insulative housing through the switch hole for operation by a person to bias the switching member between an on position where the switching member moves the first contact end to the first position to contact the first fixed electrode and an off position where the switching member moves the first contact end away from the first fixed electrode.

DETAILED DESCRIPTION OF THE PREFERRED EMBODIMENT

Figure 1:
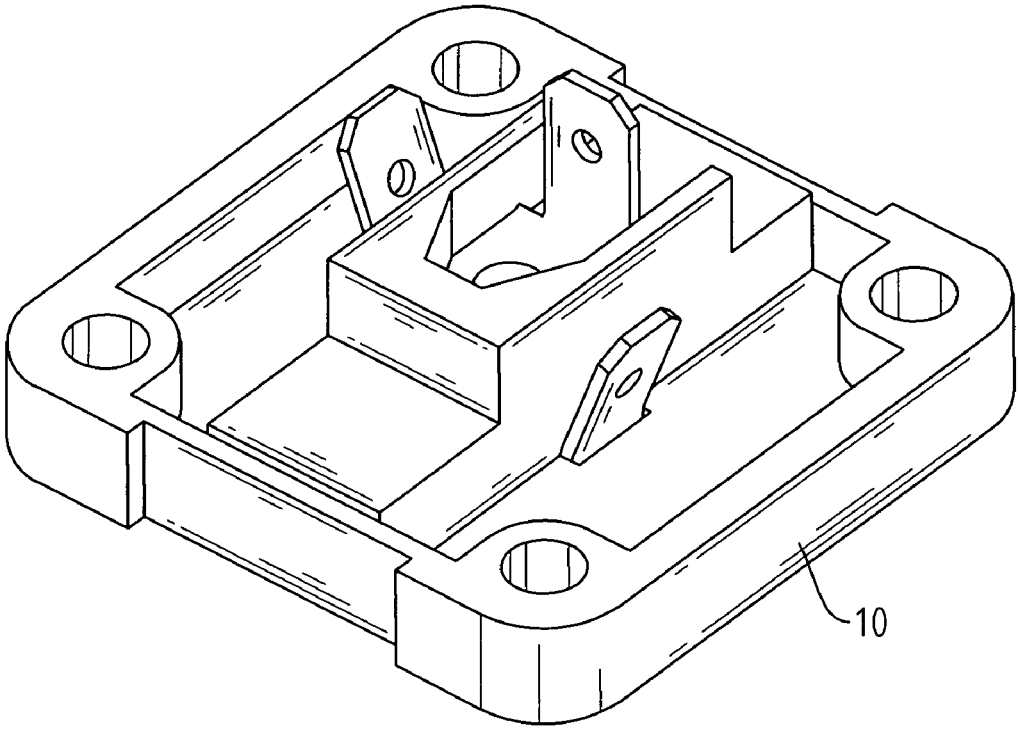
Fig. 1 Prior Art
FIG. 1 is an elevational view of an electric connector switch according to the prior art.
Figure 2:
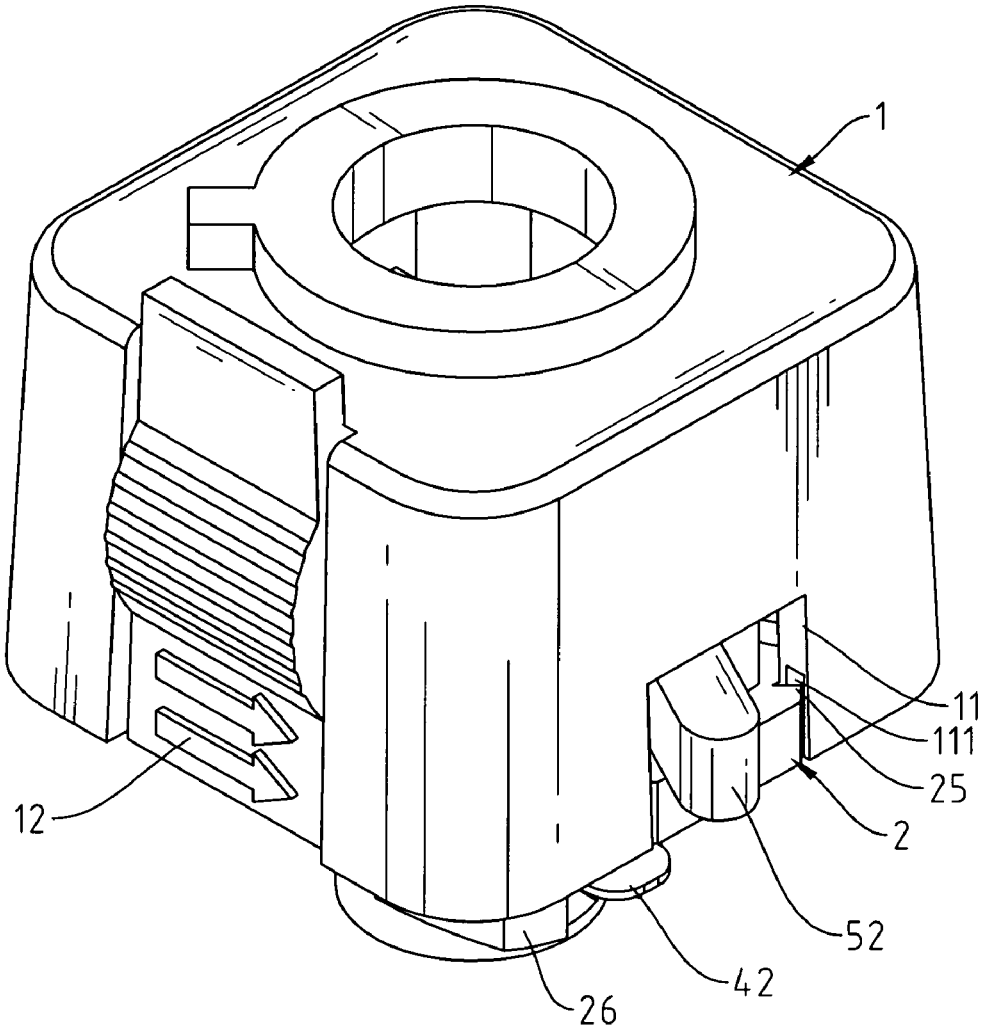
FIG. 2 is an elevational assembly view of an electric connector switch in accordance with the present invention.
Figure 3:
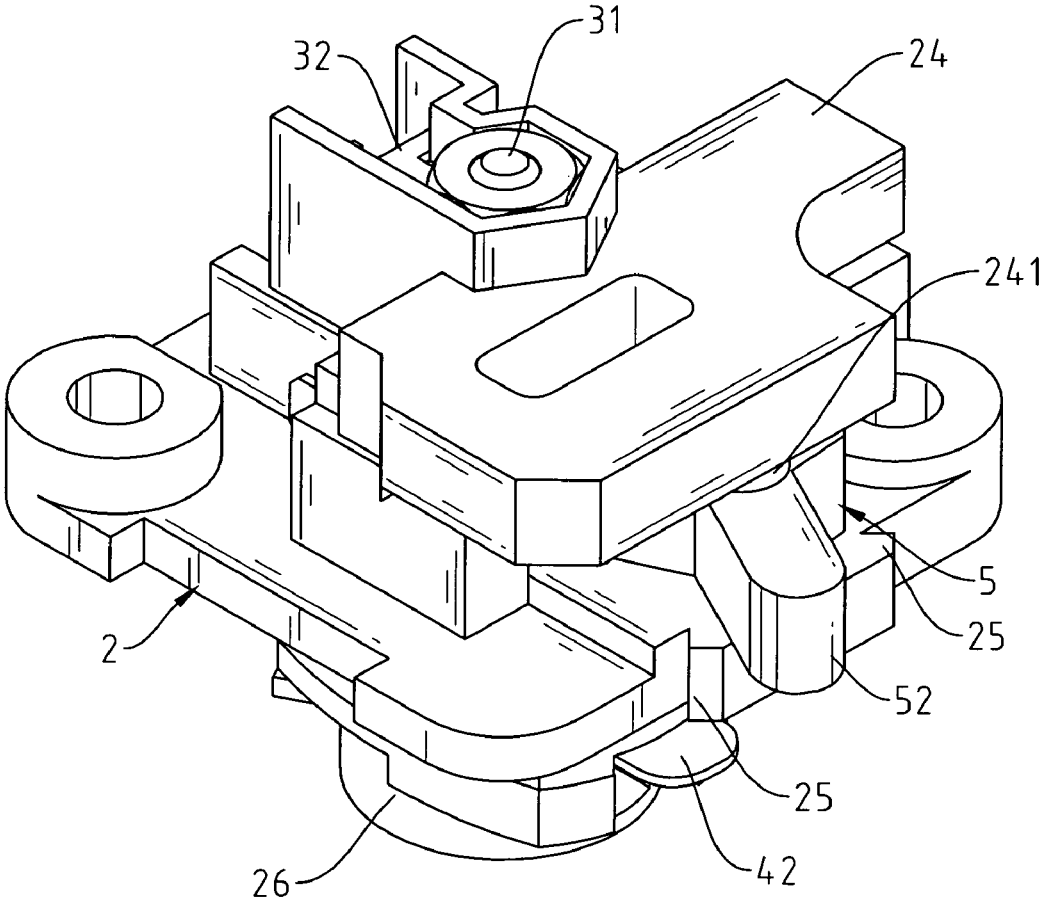
FIG. 3 is an elevational view of a part of the present invention, illustrating the internal structure of the electric connector switch in accordance with the present invention (I).
Figure 4:
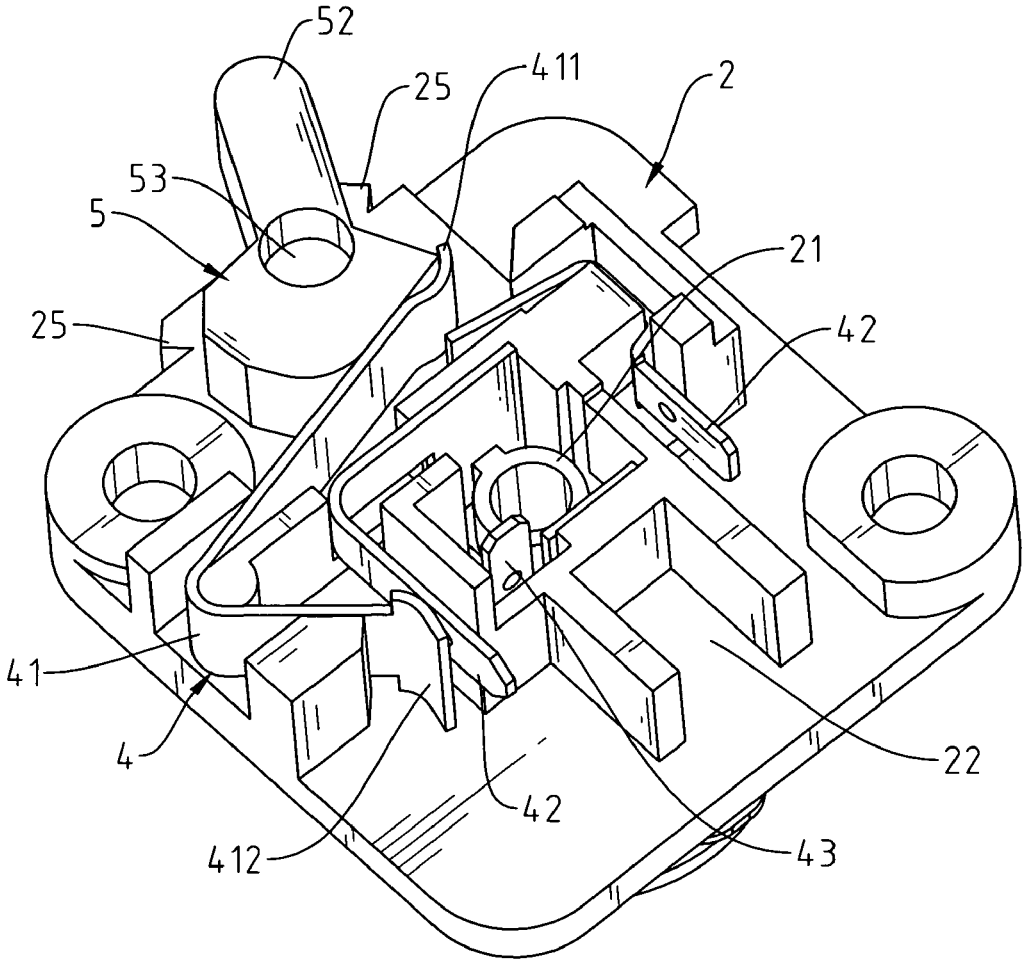
FIG. 4 is an elevational view of a part of the present invention, illustrating the internal structure of the electric connector switch in accordance with the present invention (II).
Figure 5:
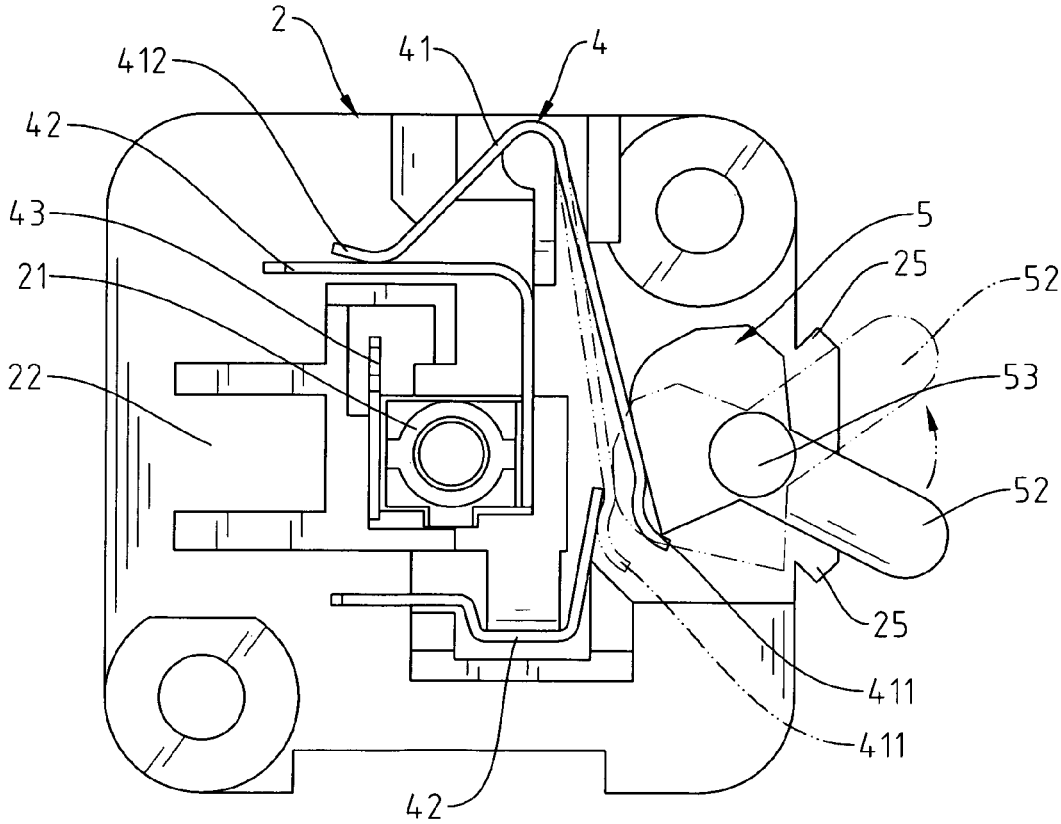
FIG. 5 is a schematic drawing showing an operation action of the switching member of the electric connector switch in accordance with the present invention.
Figure 6:
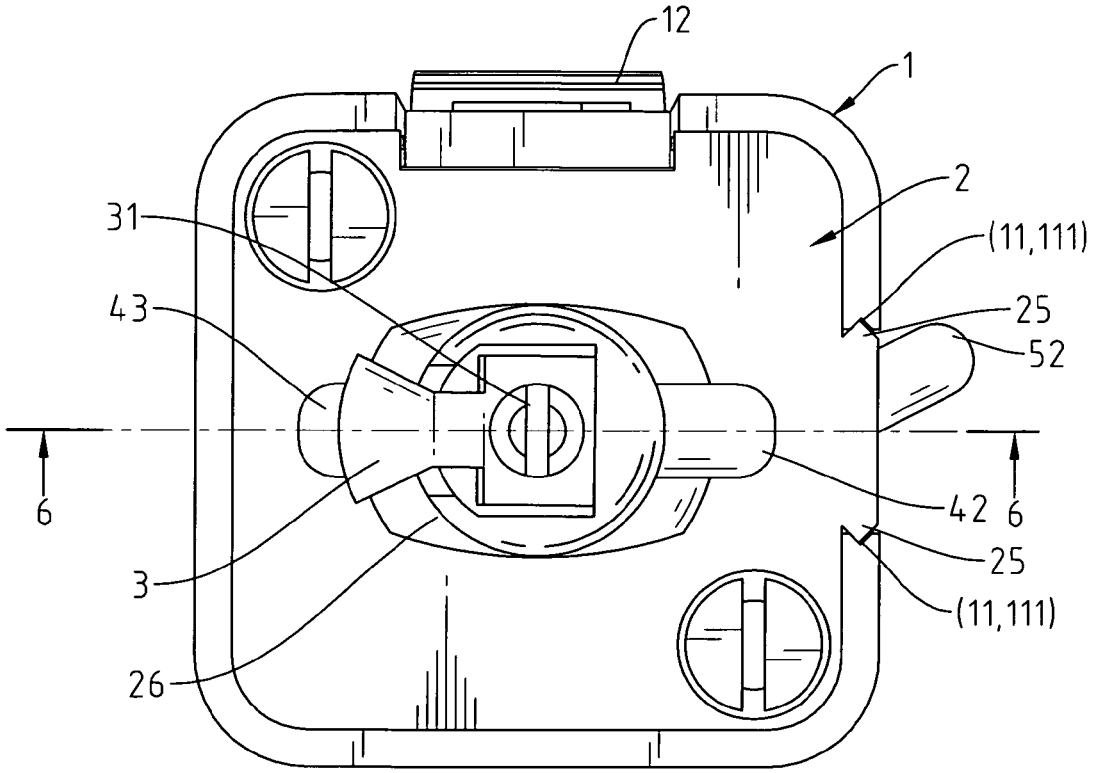
FIG. 6 is a top plain view of the electric connector switch in accordance with the present invention.
Figure 7:
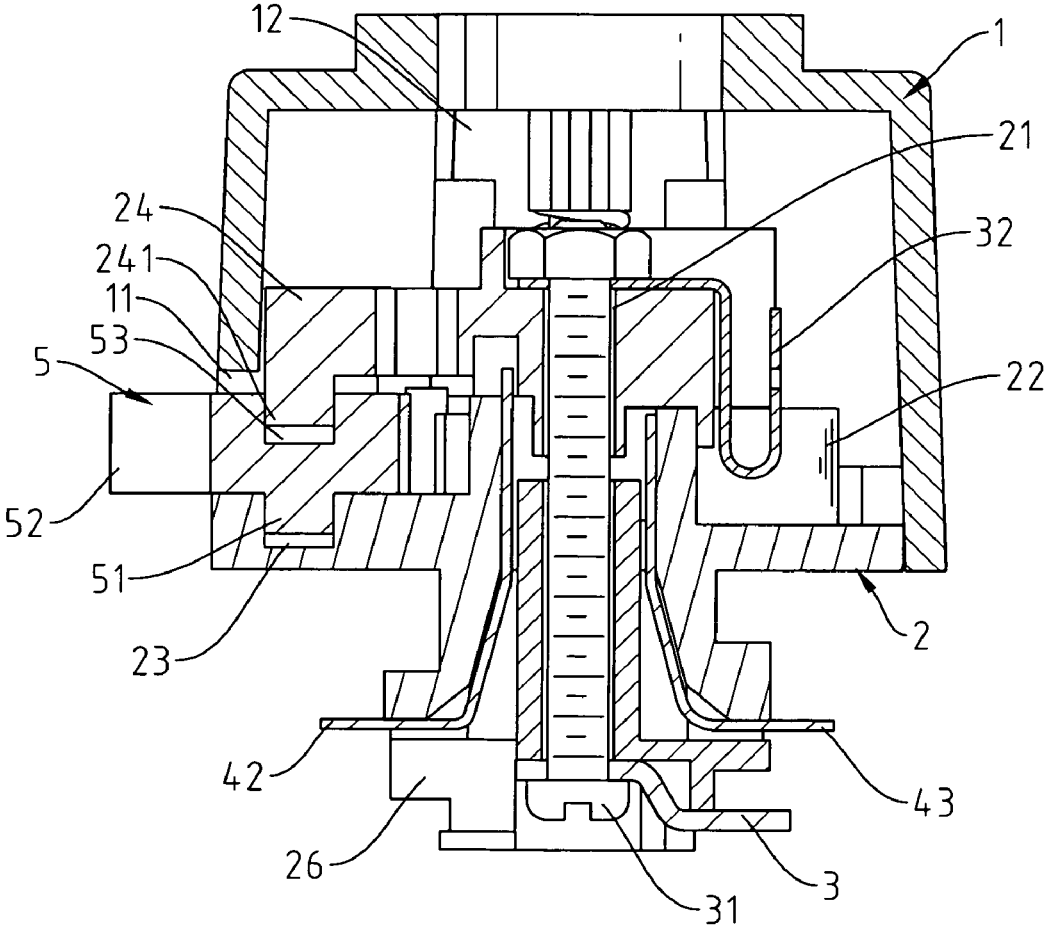
FIG. 7 is a sectional view taken along line 6-6 of FIG. 6.

Referring to FIGS. 1~3, an electric connector switch in accordance with the present invention is shown for electrically connecting a lighting fixture (not shown) to power supply, comprised of an electrically insulative housing 1, a connector 2, a grounding unit 3, a conducting unit 4, and a switching member 5. The housing 1 houses the connector body 2, having a springy retaining member 12 at one peripheral side thereof, a switch hole 11 at another peripheral side thereof adjacent to the peripheral side on which the springy retaining member 12 is located, and two locating notches 111 disposed in communication with the switch hole 11 at two opposite lateral sides. The connector body 2 comprises an axle holder 21 adapted for receiving the grounding unit 3, a trough 22 disposed adjacent to the axle holder 21, a pivot hole 23, a locating plate 24, two locating flanges 25 respectively forced into engagement with the locating notches 111 of the housing 1, and a connecting head 26 extending out of the housing 1.

The grounding unit 3 comprises a metal grounding spring plate 32, and a fastening member 31. The fastening member 31 is fastened to the pivot holder 21 to affix the metal grounding spring plate 32 and the locating plate 24 to the connector body 2, thereby securing the conducting unit 4 and the switching member 5 to the connector body 2.

The conducting unit 4 is comprised of a movable electrode 41 and two fixed electrodes 42 and 43. The fixed electrodes 42 and 43 are respectively extending to the outside of the connector head 26 for connection to the positive and negative terminals of power supply. The movable electrode 41 has a first contact end 411 and a second contact end 412. The second contact end 412 is constantly kept in positive contact with the fixed electrode 43. The first contact end 411 is movable by the switching member 5 between two positions, namely, the on position where the first contact end 411 is kept in positive contact with the fixed electrode 42 and the off position where the first contact end 411 is kept away from the fixed electrode 42.

Referring to FIGS. 4~7, the switching member 5 is an eccentric block comprising a pivot shaft 51 pivotally coupled to the pivot hole 23 of the connector body 2, a top coupling hole 53 coupled to an axle 241 of the locating plate 24, and a handle 52 extending out of the housing 1 through the switch hole 11 for biasing the switching member 5 to move the first contact end 411 between the on position and the off position to switch on/off the lighting fixture Although a particular embodiment of the invention has been described in detail for purposes of illustration, various modifications and enhancements may be made without departing from the spirit and scope of the invention. Accordingly, the invention is not to be limited except as by the appended claims.

The invention claimed is:

1. An electric connector switch comprising an electrically insulative housing, said electrically insulative housing having a switch hole, a connector body mounted inside said electrically insulative housing, said connector body comprising an axle holder, a grounding unit mounted in said connector body, said grounding unit comprising a metal grounding spring member and a fastening member fastened to said axle holder to affix said metal grounding spring member to said connector body, a conducting unit mounted in said connector body for connection to a power cable, and a switching member adapted for switching on/off the connection between said conducting unit and said power cable, wherein:

said grounding unit comprises a first fixed electrode and a second fixed electrode respectively connected to said power cable, and a movable electrode, said movable electrode having a first contact end and a second contact end, said second contact end being constantly kept in positive contact with said second fixed electrode, said first contact end being movable between a first position where said first contact end is kept in positive contact with said first fixed electrode and a second position where said first contact end is moved away from said first fixed electrode;

said switching member is pivotally coupled to a pivot hole on said connector body, having a handle extending out of said electrically insulative housing through said switch hole for operation by a person to bias said switching member between an on position where said switching member moves said first contact end to said first position to contact said first fixed electrode and an off position where said switching member moves said first contact end away from said first fixed electrode.

2. The combination connector and switch assembly as claimed in claim 1, wherein said electrically insulative housing comprises two locating notches disposed in communication with said switch hole at two opposite sides; said connector body comprises two locating flanges respectively forced into engagement with said locating notches.

3. The combination connector and switch assembly as claimed in claim 1, wherein said switching member is an eccentric block.

* * * * *